United States Patent [19]

Hix

[11] Patent Number: 4,645,200

[45] Date of Patent: Feb. 24, 1987

[54] ISOMETRIC EXERCISING DEVICE

[76] Inventor: William R. Hix, 2224 David Way, Modesto, Calif. 95351

[21] Appl. No.: 738,238

[22] Filed: May 28, 1985

[51] Int. Cl.[4] ..... A63B 21/00

[52] U.S. Cl. ..... 272/73; 272/126; 272/70; 272/97

[58] Field of Search ..... 272/73, 135, 142, 146, 272/69, 72, 125, 126; 128/25 R

[56] References Cited

U.S. PATENT DOCUMENTS

| | | | |
|---|---|---|---|
| 2,772,881 | 4/1956 | Fundom | 128/25 B |
| 3,298,688 | 1/1967 | Grzybowski | 272/142 |
| 3,467,374 | 9/1969 | Aaer | 272/97 |
| 3,566,861 | 3/1971 | Weiss | 272/126 |
| 3,768,808 | 10/1973 | Passera | 272/80 |
| 3,968,963 | 7/1976 | Sileo | 272/134 |
| 4,262,902 | 4/1981 | Dranselka | 272/132 |
| 4,300,760 | 11/1981 | Bobroff | 272/120 |
| 4,314,697 | 2/1982 | Brumfield et al. | 272/136 |
| 4,351,527 | 9/1982 | Crisp, Jr. | 272/137 |
| 4,390,177 | 6/1983 | Biran et al. | 272/73 |
| 4,391,441 | 7/1983 | Simjian | 272/146 |
| 4,434,981 | 3/1984 | Norton | 272/70 |
| 4,451,033 | 5/1984 | Nestegard | 272/73 |
| 4,463,945 | 8/1984 | Spector | 272/73 |

*Primary Examiner*—Richard J. Apley
*Assistant Examiner*—S. R. Crow
*Attorney, Agent, or Firm*—Thomas Schneck

[57] ABSTRACT

An exercise device for elderly and handicapped persons having J-shaped pedal bars pivotally mounted to a frame. Pedal bars terminate in foot pedals extending perpendicularly outwardly from the pedal bars and move in a substantially linear back-and-forth type motion. A cord fastened at each end to a pedal bar runs through a pulley on the frame to force pedals directions opposite to one another. A shock absorbing bumper prevents damage to the pulley from repeated impacts of the pedal bars. Arms terminating in handles are provided as extensions perpendicularly outwardly from the pedal bars and operate in unison with the pedal bars. A brake is held in pressed contact with the pedal bars by a knob tightened spring to provide adjustable resistance to pedal motion. The device can be used with one or both person's legs and with or without the assistance of the person's hands.

13 Claims, 4 Drawing Figures

10
72
24
74
70
16
22
20
62
68
58
60
56
52
66
76
18
38
40
θ
34
36
80
4
46
64
26
54
28
49
48
50

ISOMETRIC EXERCISING DEVICE

DESCRIPTION

1. Technical Field

The present invention relates to portable exercise devices and in particular to those foot and arm operated exercise devices for use by convalescing, elderly, handicapped or other persons who cannot engage in strenuous exercise.

2. Background Art

A large variety of exercise equipment is available. Among the most common types of exercise device is the exercise bicycle, which resembles an ordinary bicycle with the exception that its sole wheel is raised off the ground, so it is stationary. These exercise bicycles have become popular for both the casual workout and as part of a vigorous exercise program. However, exercise bicycles are large and bulky; and somewhat heavy. They are difficult to store and are not very portable. Further, these devices are not suitable for those who cannot engage in strenuous exercise.

Dranselka, in U.S. Pat. No. 4,262,902, discloses a portable pedaling type exercise device which is attachable to a conventional chair. The force required to turn the pedals can be varied by adjusting wingnuts forcibly holding brake lining material against the pedal shift. Stirrups may be provided on the pedals for securely holding the feet of elderly persons, stroke victims, or other handicapped persons to the pedals. U.S. Pat. Nos. 3,968,963 to Sileo and 4,390,177 to Biran et al. disclose other pedal- and chair-type exercise devices. The major advantages of these devices are that they are compact and portable, and the users may sit in any chair of their choosing for comfort, safety and convenience.

In U.S. Pat. No. 3,768,808 to Passera, an exercising device is disclosed in which a pair of bars is mounted for pivotal movement on a base against friction resistance. The user sits in a chair with feet secured to stirrups on the top of the bars. Exercise is accomplished by moving the bars back and forth or from side to side with the feet. An alternate set of bars having springs permits exercise by lifting and lowering.

In U.S. Pat. No. 4,314,697 to Brumfield et al, an exercise device is disclosed which is specifically designed to be used by persons who cannot engage in strenuous exercises. An exercise bar mounts to the ends of a wedge-shaped base, while a pair of springs provide the necessary resistance. The device is designed to be used on the floor so that it is easy for elderly and handicapped persons to use. A variety of exercises can be performed.

The problem with these devices is that it may be impossible for people with hip injuries or arthritis to use the pedalling type exercise devices, because such pedalling motion is injurious or impossible. Further, all of these devices require that both limbs be used. Persons paralyzed or partially paralyzed in one or both legs due to strokes or crippling diseases would be unable to use these exercise devices.

Accordingly, it is an object of the invention to provide portable exercise device that may be used in an ordinary chair or wheelchair by elderly, handicapped or other persons.

It is another object of the invention to provide such an exercise device that can be used by persons who don't have full use of both legs, or by persons with hip or other joint problems that cannot exercise in a pedalling motion.

DISCLOSURE OF THE INVENTION

The above objects have been met with an exercise device having pedals which move not in a rotary motion, but rather in a substantially linear back-and-forth type motion on adjacent J-shaped pedal bars pivotally mounted, in an upright manner, to a frame. The device uses an isometric principle of exercise in which one group of muscles oppose the efforts of others. When one pedal is pushed in one direction, the other pedal is forced in the opposite direction. This opposition of pedals is created by a pulley and a cord fastened to both pedal bars, running through the pulley. Persons with only one strong leg can still exercise their weak or paralyzed leg because the action of the strong leg on one pedal moves the weak leg on the opposite pedal.

A pair of arms extend beyond the pivot from the pedal bars and terminate in handles. These arms pivot in unison with the pedal bars and may be used to assist the exercising of weak or partially paralyzed legs. Pulling back on the left handle, for example, pushes in the left pedal and forces out the right pedal.

An adjustable friction plate is held in pressed contact with the pedal bars to increase resistance as may be desired by the user. A knob turns to increase tension of a spring attached to the friction plate.

A shock absorbing bumper is provided on the frame to prevent damage by the pedal bars repeatedly striking the frame and pulley.

With this device handicapped and elderly persons previously unable to engage in exercise can strengthen their muscles without discomfort. The user may sit in a chair or wheelchair of his or her own choice, thus eliminating the load and wear on deteriorating or arthritic joints, particularly the hip joint. Persons who can use only one leg, such as stroke victims, can also exercise their limbs to prevent muscles from atrophying.

BEST MODE FOR CARRYING OUT THE INVENTION

Figure 1:
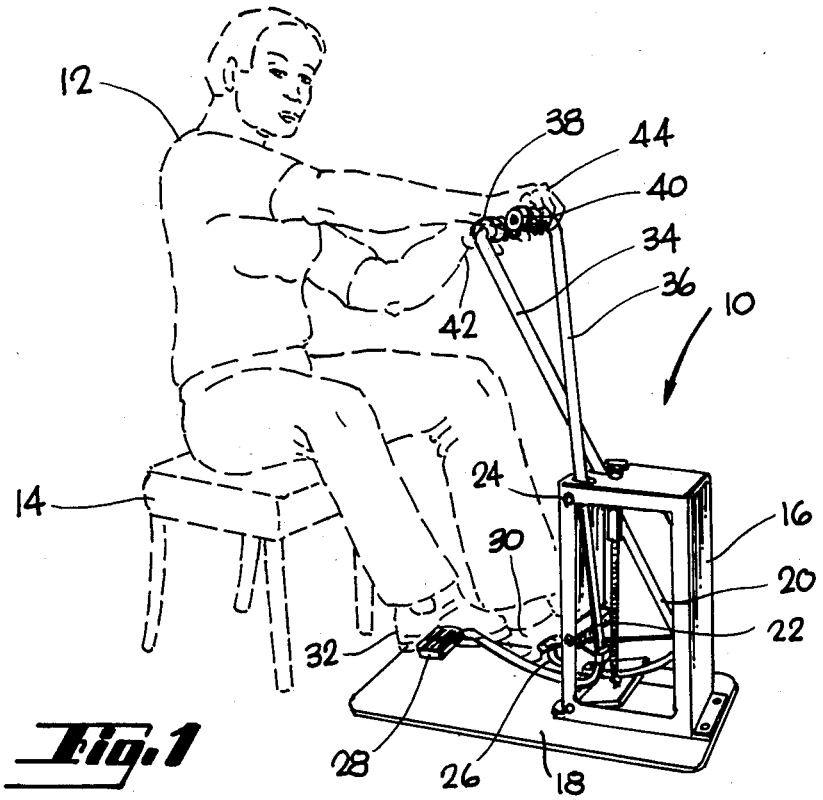
FIG. 1 is a perspective view of the present invention.

With reference to FIG. 1, an exercise device 10 is adapted for operation by a person 12 sitting in a chair 14. Chair 14 is only illustrative and may be any chair or wheelchair of the person's choice. Exercise device 10 has a boxlike frame 16 mounted on a base 18. Base 18 is generally flat and acts to stabilize exercise device 10.

A pair of J-shaped pedal bars 20 and 22 are pivotally mounted to frame 16 on a pivot shaft 24. Each pedal bar 20 and 22 terminates in a pedal 26 and 28, extending perpendicularly outwardly from the pedal bar. Feet 30 and 32 of a person 12 act on pedals 26 and 28 respectively to push them alernatively back and forth in a generally linear motion. Pedals 26 and 28 are typically made of a material such as rubber to prevent the feet from slipping. The pedals may optionally be equipped with stirrups to retain the feet in place.

Exercise device 10 has arms 34 and 36 colinearly extending beyond pivot shaft 24 from pedal bar 20 and 22. Each arm 34 and 36 terminates in a handle 38 and 40, respectively, extending perpendicularly outwardly from the pedal bar, which can be acted on by hands 42 and 44 of person 12. Arms 34 and 36 act in unison with pedal bars 20 and 22, pivoting about shaft 24. Thus when handle 38 is pushed, for example, pedal 26 moves in the opposite direction. Similarly, handle 40 and pedal 28 move in opposite directions.

Figure 2:
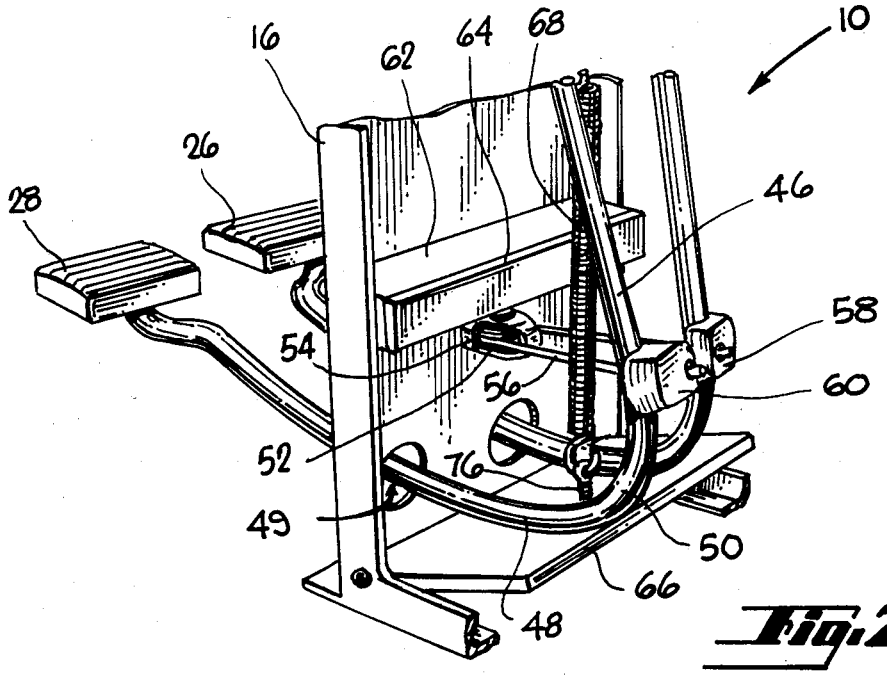
FIG. 2 is a detail of a portion of the invention shown in FIG. 1.
Figures 3, 4:
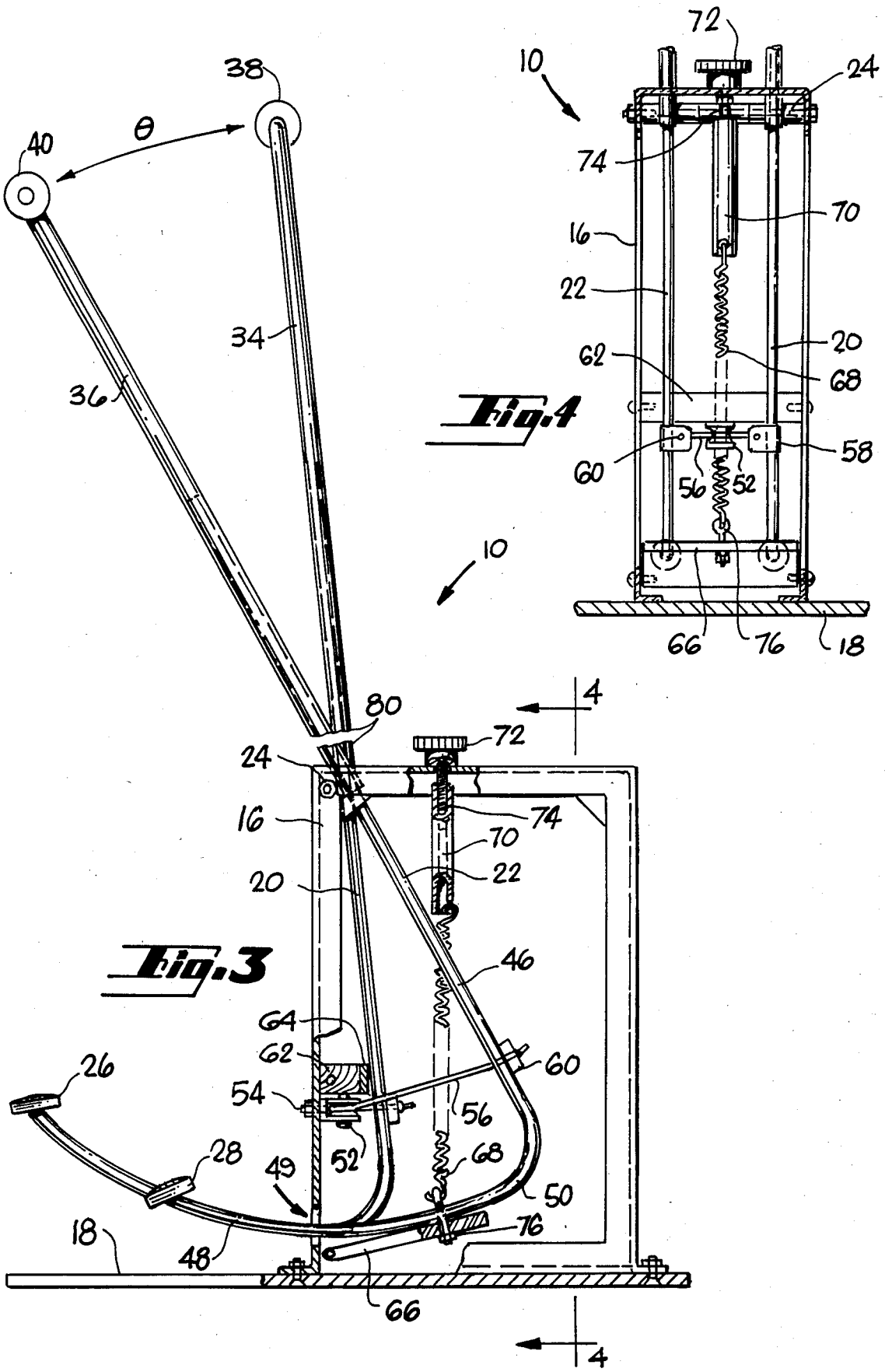
FIG. 3 is a side elevation of the present invention.
FIG. 4 is a sectional view taken along the line 4—4 in FIG. 3.

With reference to FIGS. 2–4, frame 16 is a boxlike construction of metal, plastic, wood or other sturdy material. Typically, frame 16 is about six inches wide, nine inches long, and sixteen inches high (15×23×42 cm) but other size frames may also be used.

Base 18 is generally flat, and is longer and wider than frame 16. Typically, base 18 is about one-half inch high, fourteen inches wide, and twenty-six inches long (1×36×66 cm) but other size bases may also be used. Base 18 provides stability to exercise device 10 and may be made of rubber or other, preferably nonslippery, material. Frame 16 may be mounted anywhere on base 18, but is usually mounted near one of the short sides with the pedals 26 and 28 projecting toward the opposite side.

Pedal bars 20 and 22 are mounted to a shaft 24, the shaft being pivotally supported at the front upper edge of boxlike frame 16 on a pivot shaft 24. Pivot shaft 24 may be a single rod, screwed into frame 16, with a pair of cylinders, slipped onto the rod and welded to pedal bars 20 and 22, serving as journal bearings. Any other way of pivotally mounting pedal bars 20 and 22 to frame 16 may also be used.

Pedal bars 20 and 22 have a J-shape, including a straight part 46 and an arcuate part 48. Straight part 46 starts at pivot shaft 24 and typically extends for about fifteen inches (38 cm). Straight part 46 bends into arcuate part 48 at a bend 50. Arcuate part 48 is typically about twelve inches long (30 cm) with a radius of curvature of the length of straight part 46. Arcuate part 48 of pedal bars 20 and 22 projects through openings 49 in frame 16 and terminates in pedals 26 and 28. Straight part 46 and arcuate part 48 of pedal bars 20 and 22 may be a single contiguous piece, or alternatively may be two distinct pieces joined together, but in any case operate together as one piece. Pedal bars 20 and 22 are preferably metal or other strong, durable material.

A pulley 52 is secured by a block 54 to frame 16. Pulley 52 is located between pedal bars 20 and 22 on the front part of frame 16 between shaft 24 and openings 49. Preferably, pulley 52 is level with the bottom end, near bend 50, of straight part 46 for greater range of motion and smoother operation.

A cord 56 is tied at one end to pedal bar 20 by a tie 58, runs through pulley 52, and is tied at an opposite end to pedal bar 22 by a tie 60. The term "cord" is used here as a general term for any cable, wire, cord, rope, string, band, line or chain that may be used in connection with a pulley. Metal cable is preferred for its durability, but any cord material may be used for cord 56. Cord 56 is typically about ten inches (25 cm) long.

A bumper 62 is mounted to the front part of frame 16 above pulley 52. Bumper 62 is typically made of wood or hard rubber and has a shock absorbing pad 64. Pad 64 is made of foam or other shock absorbing material and is disposed to absorb the shock from the straight part 46 of pedal bars 20 and 22. Bumper 62 protects pulley 52 and frame 16 from repeated blows from the pedal bars 20 and 22.

Exercise device 10 has arms 34 and 36 which extend upward from pedal bars 20 and 22 respectively and terminate in handles 38 and 40. Arms 34 and 36 may be contiguous with pedal bars 20 and 22 as one piece, or they may be fitted over and secured to the ends of pedal bars 20 and 22. Typically, arms 34 and 36 are metal or other strong, durable material and are about 18 inches (45 cm) long.

A brake 66 is connected to frame 16 beneath arcuate part 48 of pedal bars 20 and 22 and is held in pressed contact with pedal bars 20 and 22 for applying a resistive force to pedal bars 20 and 22. Brake 66 is typically a four by six inch flat plate (10×15 cm) of a high friction material, such as rubber. Wood with grooves for seating pedal bars 20 and 22 may also be used.

Brake 66 is held against pedal bars 20 and 22 by a spring 68. Spring 68 is typically a conventional spring about eight inches (20 cm) long and fastened at one end to brake 66 by a cotter pin 76. Other fasteners can also be used instead of cotter pin 76. Spring 68 is fastened on the opposite end to a rod 70. Rod 70 is in turn screwed into a knob 72 on top of frame 16 for adjusting the tension of spring 68. Rod 70 is generally cylindrical in shape and 3 inches (8 cm) long. Its end opposite spring 68 has an internal screw for receiving an external screw 74, part of knob 72. Turning knob 72 in one direction screws external screw 74 into rod 70, drawing rod 70 closer to frame 16. This action stretches spring 68, increasing its tension and increasing the pressure of brake 66 on pedal bars 20 and 22. Turning knob 72 in the opposite direction reduces the pressure of brake 66 on pedal bars 20 and 22.

In operation, pushing on one pedal, pedal 26 for example, draws cord 56 attached to pedal bar 20 at tie 58 through pulley 52. Cord 56 is also attached to pedal bar 22 at tie 60, so as cord 56 is drawn through pulley 52, pedal 28 is forced in the opposite direction from pedal 26. Similarly, pushing pedal 28 forces pedal 20 in the opposite direction.

Arms 34 and 36 operate in unison with pedal bars 20 and 22. Pulling on one arm, arm 34 for example, causes corresponding pedal bar 20 and pedal 26 to be pushed toward frame 16. Pedal 28 is forced in the direction of motion of arm 34. Similarly, pulling on arm 36 moves pedal 26 in the same direction and pedal 28 toward frame 16.

Arcuate part 48 of pedal bars 20 and 22 have a range of motion of about eight inches (20 cm). For pedal bars 20 and 22 having fifteen inch (38 cm) long straight parts 46, the pivoting motion of the pedal bars can occur over only about a 30 degree arc. This range of motion for pedal bars 20 and 22 is limited by bumper 62 in the front and by frame 16 and the length of cord 56 in the back. Because pivoting occurs over only about 30 degrees of arc, motion of pedals 26 and 28 is substantially linear, rather than rotary.

Exercise device 10 can be operated with a person's legs or by all four limbs in a coordinated motion. If one leg is weak or paralyzed, then pushing on a pedal with the good leg forces the other pedal in the opposite direction. The weakened leg then suppresses its pedal either by its own weight, or with the help of one or both hands on the handles 38 and 40. If both legs are weak or paralyzed, the device 10 can be operated solely with a person's hands. In the situation involving only foot operation, the pedal bars are needed, but the arms are not. A devise without arms is indicated by broken lines 80 in FIG. 1. In the situation involving hand and leg operation, arms as well as pedal bars are needed. In both situations tensions must be maintained on cord 56 to promote isometric excercise of the user's limbs.

I claim:

1. An exercise device comprising, a frame, first and second J-shaped pedal bars having upper and lower ends and being pivotally mounted to said frame, the lower ends terminating in foot pedals, first and second arms, said first arm extending from said upper end of said first pedal bar, said second arm extending from said upper end of the second pedal bar, each of said arms terminating in a handle extending perpendicularly outwardly from said arms, and means connected to aid pedal bars for isometrically opposing motion of one foot pedal in one direction when said other foot pedal is pushed in the opposite direction, the foot pedals being movable in a substantially back-and-forth type motion, said back-and-forth type motion of a foot pedal pivoting an associated arm in an opposite direction.

2. The exercise device of claim 1 wherein said opposition means comprises, a pulley secured to said frame, a cord fastened at one end to said first pedal bar and at an opposite end to said second pedal bar, said cord running through said pulley.

3. The exercise device of claim 1 further comprising:

friction means disposed for applying an adjustable resistive force to said pedal bars.

4. The exercise device of claim 3 wherein said friction means comprises, a spring having first and second ends, a brake attached to said first end of said spring and held in pressed contact with said lower ends of said pedal bars by said spring, and spring adjusting means attached to said frame and said second end of said spring for adjusting tension of said spring thereby modifying the pressure of said brake against said lower ends of the pedal bars.

5. The exercise device of claim 1 wherein said back-and-forth type motion has an arc of between 0° and 45°.

6. An exercise device comprising, a frame connected to a base;

first and second J-shaped pedal bars mounted at a pivot to said frame said pedal bars having a lower end and an upper end, said lower ends terminating in foot pedals, the foot pedals being movable in substantially back-and-forth type motion, a pulley secured to said frame, a cord fastened at one end to said first pedal bar and at an opposite end to said second pedal bar, said cord running through said pulley for enabling said back-and-forth motion, and a first and second arm, said first arm extending beyond said pivot from said upper end of the first pedal bar, said second arm extending beyond said pivot from said upper end of said second pedal bar, each of said arm terminating in a handle, said back-and-forth type motion pivoting an associated arm in an opposite direction.

7. The exercise device of claim 6 further comprising friction means disposed for applying an adjustable resisitive force to said pedal bars.

8. The exercise device of claim 7 wherein said friction means comprises, a spring having first and second ends, a brake fastened to said first end of said spring and held in pressed contact with an arched portion of said J-shaped pedal bars by said spring, and spring adjusting means attached to said frame and to said second end of said spring for adjusting tension of said spring thereby modifying the pressure of said brake against said arched portion of said pedal bars.

9. The exercise device of claim 6 further comprising, bumper means connected to said frame beneath said pivot for adsorbing shock from said pedal bars striking said frame.

10. An exercise device comprising, a frame secured to a base, first and second pedal bars pivotally mounted to a upright shaft of said frame and terminating in foot pedals below the pivotal mounting, the foot pedals being movable in a substantially back-and-forth motion, said pedal bars having upper ends and lower ends, said upper ends extending above the pivotal mounting and beyond said shaft into first and second arms, each said arm terminating in a handle, a pulley secured by a block to said frame, a cord fastened at one end to said first pedal bar and at an opposite end to said second pedal bar, said cord running through said pulley for enabling said back-and-forth motion a spring having first and second ends, a brake fastened to said first end of said spring, and held in pressed contact with said lower ends of said pedal bars by said spring, and spring adjusting means attached to said frame and to said second end of said spring for adjusting tension of said spring, thereby modifying the pressure of said brake against said lower ends of said pedal bars.

11. The exercise device of claim 10 wherein said spring adjusting means comprises, a rod attachable at one end to said second end of said spring and terminating at an opposite end in an internal screw, and a knob having an external screw, said external screw being fitted through an opening in said frame and screwed by an adjustable amount to said internal screw of said rod, the amount of screwing determining the distance of said rod from said frame.

12. The exercise device of claim 10 further comprising, bumper means connected to said frame beneath said pivot for absorbing shock from said pedal bars striking said frame.

13. The exercise device of claim 6 wherein said back-and-forth type motion has an arc of between 0° and 45°.

* * * * *